United States Patent [19]

Lerman et al.

[11] 4,073,992

[45] Feb. 14, 1978

[54] PRINTING ON A POLYOLEFIN SUBSTRATE

[75] Inventors: Frank Lerman, Cincinnati; Raymond C. Bartsch, Wyoming, both of Ohio

[73] Assignee: National Distillers and Chemical Corporation, New York, N.Y.

[21] Appl. No.: 524,176

[22] Filed: Nov. 15, 1974

Related U.S. Application Data

[63] Continuation of Ser. No. 311,180, Dec. 1, 1972, abandoned, and a continuation-in-part of Ser. No. 23,044, March 26, 1970, abandoned.

[51] Int. Cl.[2] ..... B41M 5/26

[52] U.S. Cl. ..... 428/207; 101/426; 106/20; 106/23; 427/197; 427/199; 428/208; 428/516 X

[58] Field of Search ..... 101/426; 106/20, 23; 427/197, 199; 428/207, 208, 516

[56] References Cited

U.S. PATENT DOCUMENTS

| | | | |
|---|---|---|---|
| 2,594,290 | 4/1952 | Chauannes | 101/426 X |
| 2,612,480 | 9/1952 | May | 101/426 X |
| 2,632,921 | 3/1953 | Kreidl | 101/426 X |
| 2,639,998 | 5/1953 | Pavlic | 101/426 X |
| 3,545,997 | 12/1970 | Hochberg | 117/21 |
| 3,577,915 | 5/1971 | Thompson | 101/129 |

OTHER PUBLICATIONS

*Printing Inks*, "Tack and Viscosity", Reinhold Pub. Co., 1940, pp. 116–118.

*Primary Examiner*—Clyde I. Coughenour
*Attorney, Agent, or Firm*—Kenneth D. Tremain

[57] ABSTRACT

A method is provided for forming an adherent image, such as a design, print, or decoration, on a substrate by applying a fusible pigmented polyolefin powder in a selected pattern to a hot surface of a polyolefin substrate, and fusing the particles of the powder to each other and to the surface to form the image on cooling.

10 Claims, No Drawings

PRINTING ON A POLYOLEFIN SUBSTRATE

This is a continuation of application Ser. No. 311,180 filed Dec. 1, 1972, now abandoned and a continuation-in-part of application Ser. No. 23,044 filed Mar. 26, 1970, now abandoned.

In printing, an image is transferred to the surface of a substrate by a printing plate or cylinder on which the image to be printed appears as raised areas, sunken areas, or specially-prepared ink-receptive areas. These techniques require precision in the handling of the ink, the registration and adjustment of the image with respect to the printing medium and the substrate, and the feeding and withdrawal of the substrate to be printed upon. Considerable pressure must often be used to transfer the ink to the substrate, and the printing surfaces must be maintained level and to very close tolerances, in order to maintain an even ink transfer.

In an attempt to circumvent some of the above difficulties associated with conventional printing techniques, electrostatic printing techniques were developed which eliminate the need for pressure and uniformity of contact at the printing surface. In the electrostatic technique, an electrically charged conducting stencil screen is employed as an image-forming master. The substrate to which the image is to be applied must either be electrically conductive, or provided with a conductive backing plate or ground roughly parallel to the stencil screen with a space between it and the screen. The screen must correspond in size to the image area of the substrate to shield those portions not to be covered with the image. The substrate and/or plate is maintained at an opposite polarity from that of the screen. A finely-divided powdered electrostatic ink is applied to the outside of the screen. The particles are free to move, and are thus attracted across the gap between the screen and substrate, and are deposited on the substrate in an image conforming to the image pattern on the screen. The image which is composed of loose electrically-charged particles can then be fixed by fusing the particles to each other and to the substrate by heat, solvent vapor or other suitable means. Any substrate that is nonconducting, such as a paper sheet, and which is superimposed on a conductive backing plate, will be printed in the same manner. The problem with such conventional electrostatic printing techniques is that the loose particles can easily be disarranged or brushed off before they are fixed.

Some substrates pose additional problems. It is especially difficult to print on polyolefins, particularly polyethylene and polypropylene. The surfaces of these plastics are hydrophobic and are not "wet" by the printing ink. As a result, the ink is not anchored on the plastic surface and has little, if any, adherence thereto, even after fusing. Additionally, electrostatic printing techniques are difficult because the available electrostatic particles do not adhere to the plastic surface.

In order to overcome the difficulties encountered in printing on polyolefin surfaces, the plastic substrates are subjected to a treatment, before printing, designed to provide a surface which is sufficiently hydrophilic, i.e., "wetable" or has sufficient anchoring sites to accept the ink. Generally, three techniques are available — chemical, electronic and heat. While simple, chemical treatments have the disadvantages of requiring strong chemical solutions, are expensive, require rinsing, drying and disposal facilities, chemically resistant treating tanks, and treating times are comparatively long. Electronic treatment, e.g., corona discharge, is almost exclusively used with sheet type material and only rarely with molded items. The most common treatment is heat and in most cases, an open flame is impinged on the plastic surface.

In accordance with the invention, a method is provided for forming an adherent pattern, decoration or image on a polyolefin substrate by applying a pigmented polyolefin powder in a selected pattern to hot areas on the surface of the substrate, and fusing the particles of the powder to the substrate surface and to each other.

Further in accordance with the invention, polyolefin substrates are provided having permanently adherent to a surface thereof, an image in the form of a layer of powder particles fused to the substrate surface and to each other.

Adherence of the image to the substrate can be improved by applying a top film or coating of fusible resin thereover, and then fusing this to the image, and, if possible, to the substrate also. In addition, a clear lacquer, such as a solution of a resin compatible with the image, and preferably with the substrate, in a solvent that is not a solvent for the material forming the image, can be applied over the image and substrate surface. The solvent can then be evaporated as by application of heat, to form a film in situ over but not disturbing the image. A clear film can be fused to the image and/or substrate, employing the techniques discussed herein to improve bonding. The film on cooling acts as a protective layer or shield for the image, and also ensures good permanent adherence of the image to the substrate.

The fusible powder can be applied to selected hot areas of the surface of the substrate to form a layer that constitutes the image. The entire surface of the substrate can be heated, in which case the powder is applied only to areas within the zone of the desired image. This can be done by screening the powder particles so that they are applied to the substrate only in the selected pattern or image zone. Alternatively, but less desirably, the surface can be heated only in those areas that constitute the image zone. In this event, the powder particles can be applied en masse to the substrate; since they will adhere only where they become fused thereto, the non-adherent particles can be dumped or brushed off, leaving the desired image on the selected hot areas. The screening of the particles thus can be dispensed with. The substrate can be heated in the selected pattern or image zone areas by infra-red or ultrasonic or high frequency radiation so as to heat such areas preferentially to the particle-fusing temperature before the other areas can become heated by conduction through the substrate surface. Such radiation can be screened by a stencil screen in the desired pattern.

It is possible to provide any type of surface effect on the image. The image can have a rough or matte surface, or it may have a smooth or glossy surface. A rough surface can be obtained by using a small quantity of fusible powder, less than that required to form a smooth or glossy surface, and incomplete fusing, so that the particles do not run together fully, and retain an uneven surface in the layer. The size of the particles of fusible powder has an effect in this.

An image can be formed on a surface from which it is removably adherent and then transferred to the surface of the substrate by bringing the substrate into contact with the image layer, adhering them together by heat, and then cooling, if necessary, and stripping the image, now adherent to the substrate, from the first surface. If the initial surface is textured, the surface of the image and the substrate can retain such texture design. The substrate acquires this characteristic if it is also brought into contact with the surface while bonding the image thereto. The initial surface may then be stripped from the image, leaving the same tightly anchored to the substrate. It is preferable that the image and substrate be cooled prior to separating the initial surface, to perfect the bond thereto, and avoid faulty stripping.

The bilayered composite of the substrate and image can be fixed on a surface of another substrate, image-side or substrate-side in, and bonded thereto, employing heat or solvent, and/or adhesive coatings, or other means. For example, a polyethylene film having a lettering pattern thereon can be placed on the surface of a plastic bottle, lettering side in, and permanently fused to the bottle by applying heat to the film and/or bottle, thereby forming a covered label fused on the bottle.

The fusible powder employed in forming the pattern on the substrate is a pigmented film-forming olefin polymer or copolymer. In general, the olefinic monomers are $\alpha$-olefins containing 1 to 10 carbon atoms. Exemplary olefin polymers and copolymers include the various forms of polyethylene (i.e., low and high density polyethylene), polypropylene, poly(butene-1), poly(-pentene-1), poly(3-methyl-butene-1), poly(4-methyl-pentene-1), ethylene-vinyl acetate copolymers, and the like.

The powder should have an average particle size within the range from about 1 to about 200 microns, preferably within the range from about five to about 50 microns. If the particles are to be carried onto the substrate by electrostatic forces, the particle size is preferably within the range from about 5 to about 20 microns and the particles should be homogeneous, that is, all particles should have the same composition and electrical behavior.

The particles should also preferably be substantially spherical, free-flowing, and non-caking. Spherical particles may be formed as described in U.S. Pat. No. 3,449,291, dated June 10, 1969.

The fusible powder is pigmented, i.e., colored. Any suitable pigment, dye or opacifier, brightener or fluorescent agent for the resin can be used. It should be heat-stable at the dispersion temperature, and should not react deleterious with the powder although it can react with the powder in order to more firmly bond the agent to the particles of the powder. The coloring agent should preferably be light-stable, and should not leave or migrate from the resin during or after dispersion. Examples of suitable coloring agents include carbon black, phthalocyanine blue, fluorescent coloring agents or dyes, phthalocyanine green, cadmium sulfide, cadmium sulfide-selenide, titanium dioxide, calcined iron oxide, chromic oxide, and zinc oxide. A process for preparing colored polymer powders is described in U.S. Pat. No. 3,449,291.

The concentration of coloring agent is within the range from about 0.001 to about 1 part by weight per part of the polymer-colorant mixture. Usually, the concentration is within the range from about 0.005 to about 0.2 part, with the preferred proportion being from about 0.02 to about 0.15 part. The resin particles and pigment essentially constitute the fusible powder, and it is unnecessary to use additional special additives.

If the particles of fusible powder are not substantially spherical and/or homogeneous and/or of the required size, flow additives can be added to the particles to improve the flow properties thereof. Examples of such flow additives include colloidal silica such as Cab—O—Sil, and lightweight, porous silica aerogels from which water has been removed, such as the Santocels. The flow additives can be employed in an amount within the range from about 0.01 to about 10% and preferably from about 0.5 to about 1% by weight of the fusible powder. In some uses, it is important for the powder to have a different density from that of the particles. Density can be changed by the incorporation of foaming agents or heavy fillers.

The invention is applicable to polyolefin substrates. Thus, the substrate can be made of any of the olefin polymers set out above as fusible powders, although it need not be the same material as the fusible powder. However, to ensure good fusion and fixing of the powder on the substrate, the powder and substrate should preferably be of compatible material, and the powder should be lower melting than the substrate to ensure fusion to form the image without distortion of the substrate.

The substrate can be in any form or shape. Sheet material, plates, and shaped articles, such as containers, dishes, furniture, and art objects, including those with curves, ridges, surface indentations, flutings, convolutions and grooves, can be decorated.

A pattern of the fusible powder is laid down on the substrate in the desired image in any of several ways. For example, the powder can be applied in a desired image by electrostatic printing, as discussed above. The stencil or screen is prepared so that the open areas designate the image to be laid down on the substrate, while the closed areas protect the remainder of the area outside the image zone. The open areas can be screened by mesh of any size; the finer the mesh, the better is the definition of the image, and the finer the particle size and the better the particle flow required. Screens having a mesh size within the range from about 100 to about 400 U.S. screen mesh give good quality images, with screens of 325 and higher U.S. mesh giving the higher resolution images. The ultimate fineness of the screens is limited by the size of the particles of the fusible powder which must pass through the openings of the screen to lay down the image.

The conductive screen can be made of any conductive material, such as metal gauze, but can also be made of electrically conductive plastic, such as conductive nylon. The electrically conductive back plate is spaced some distance away from and parallel to the stencil or screen. The substrate is between the screen and the backplate. The stencil or screen and the plate are given opposite electrical charges, thereby establishing an electrostatic field therebetween. The fusible powder is distributed by brush, or by powder cloud, or other conventional techniques, to the stencil. The powder particles pass through the open areas of the stencil and through the screen; in the course of doing so, they acquire a charge of the same polarity as the screen. The substrate is heated to a temperature higher than the melting point of the particles of the powder. The particles which pass through the screen in the pattern of the stencil move toward the oppositely charged backplate and are deposited on the hot substrate, whereupon the particles soften and fuse to each other, forming a layer in the form of the desired image, which upon solidification becomes bonded to the substrate.

In order to obtain good image resolution and delineation, the distance which the particles of fusible powder must travel before contacting the substrate should be kept to a minimum, and will vary with the size and/or density of the particles of fusible powder, and the speed at which they are propelled toward the substrate. The precise distance which should be employed can be worked out by trial and error in a given instance, as will be apparent to one skilled in the art.

Prior to applying the powder to the substrate, the surface of the substrate to which the fusible powder is to be applied is heated to a temperature sufficiently high to fuse, soften, melt or liquefy the fusible powder, preferably almost instantaneously on contact. Any conventional heating means can be employed. It is unnecessary, however, to subject the substrate to a chemical, electronic or heat preparatory treatment.

In order to inhibit distortion, only the surface of the substrate should be heated. The remainder of the substrate can be cooled by cooling coils, cold water sprays, or jackets, or other convenient means. The entire surface of the substrate can be heated, or, if desired, only selected areas of the substrate can be heated. Where the particles of fusible powder are applied to the selected pattern of hot areas on the surface of the substrate, the particles fuse, soften, melt or liquify almost instantaneously to each other to form an adherent mass thereon defining the image.

After the particles of the powder are fused to each other to form an image and are fused to the substrate, the image is allowed to cool and thereby to solidify. Generally, the image will cool and solidify at room temperature. However, if necessary, cooling and solidification can be accomplished employing conventional cooling means as mentioned above.

Enough particles of the powder are applied to the substrate to form an image layer thereon having a thickness within the range from about 0.2 to about 10 mils and preferably within the range from 1 to about 5 mils. However, if the image is to be transfered to the substrate, and stripped from a different surface, for example to form a label, the layer should be thick enough to be strong and self-supporting. In such case, enough particles of fusible powder should be applied to the surface to form an image layer thereon having a thickness within the range from about 0.5 to about 20 mils and preferably within the range from about 1 to about 10 mils.

The following Examples in the opinion of the inventor represent preferred embodiments of his invention.

EXAMPLE 1

An image in the form of lettering was applied to a polyethylene bottle as follows:

A stencil screen carrying an open pattern of the letters to be applied screened with 325 mesh stainless steel was positioned over and in close proximity to the portion of the bottle surface to be lettered, and the surface of the bottle was then heated by infrared radiation to 125° C., while the inside was cooled by an air stream. A fusible phthalocyanine blue-pigmented polyethylene powder, composed of particles ranging from 20 to 50 microns was brushed through the screen in the screened lettering portion of the stencil onto the hot surface of the bottle. The powder melted upon contact with the hot surface, and fused to the bottle surface. Enough powder was applied to completely coat the bottle with a pigmented image layer in the region of the letters, and upon cooling the clear lettered legend of the stencil was found to be durably bonded to the bottle.

EXAMPLE 2

A lettered image was applied to a polyethylene bottle, employing an electrostatic stencil screen technique, as follows.

A stencil having a pattern of open areas corresponding to the desired lettered image and a 325 mesh stainless steel screen were placed in close proximity to the surface of a polyethylene bottle, screen side towards the bottle. The surface of the polyethylene bottle to which the powder was applied was heated by infrared radiation to about 125° C. An electric charge was applied to the screen, and a fusible carbon-pigmented polyethylene powder having an average particle size of about 15 microns was brushed through the screen, whereupon it acquired the same charge. An opposite charged conductive plate was behind the polyethylene bottle. The fusible powder which flowed through the open portions of the stencil and screen was attracted to the charged backplate but deposited on the hot surface of the polyethylene bottle in a lettered pattern corresponding to the letter pattern of the stencil. The particles of fusible powder laid down on the hot surface melted, fused to each other, and were bonded to the hot surface of the bottle. Enough particles were applied to cover the bottle surface within the confines of the letter of the pattern, and form a lettered image layer thereon. The polyethylene bottle was thus labeled in the pattern of the stencil, and upon cooling, the labeling was firmly bonded to the surface thereof.

EXAMPLE 3

A stencil was mounted on a 325 mesh stainless steel screen and the stencil screen was placed in close proximity to the surface of a glass bottle, screen side towards the bottle. The surface of the bottle was heated with a heat lamp to over 125° C. A fusible carbon black-pigmented polyethylene powder having an average particle size of about 15 microns was brushed through the stenciled screen to the hot surface of the glass bottle, and deposited in a pattern corresponding to the pattern on the stencil screen. Upon contacting the hot surface of the bottle, the particles of the polyethylene powder melted and fused to each other. Enough particles were applied to form an image layer on the surface of the bottle in the pattern laid down.

A polyethylene film was placed over the image layer of fused polyethylene powder on the surface of the glass bottle, and fused onto the polyethylene image layer by heating the composite with a heat lamp for ten minutes. Upon cooling, the polyethylene film solidified, and was stripped off the glass bottle, taking with it the image layer.

This transfer film was used to label a polyethylene bottle. It was placed on the bottle with the image layer face down, and the polyethylene bottle and film were heated with a heat lamp for ten minutes. The polyethylene film and fused image were thereby permanently fused to and bonded to the polyethylene bottle, as a label on the bottle.

EXAMPLE 4

A stencil was mounted on a 325 mesh stainless screen, and the stencil screen was placed in close proximity to the hot surface of a frosted glass bottle, screen side towards the bottle. The bottle surface was heated to 125° C. A fusible blue-pigmented polyethylene powder having an average particle size of about 30 microns, and containing 0.5% by weight colloidal silica (Cab—O—Sil) to increase the flowability of the powder, was brushed through the stencil screen, and was deposited in a pattern corresponding to the pattern of the stencil. Upon contacting the hot surface of the frosted glass bottle, the particles of the polyethylene powder melted and fused to each other. Enough particles were applied to form an image layer which upon cooling adhered to the surface of the bottle.

A polyethylene film was then applied over the image layer, and the film and bottle were heated by a heat lamp for ten minutes, thereby fusing the image layer of fused powder to the polyethylene film.

Upon cooling, the polyethylene film with the image of fused polyethylene powder fused thereto was stripped off the surface of the frosted glass bottle. The image of fused powder as well as the texture design of the frosted glass bottle was thereby transferred to the polyethylene film.

What is claimed is:

1. A method of forming an image on a polyolefinic substrate which comprises applying a dry fusible powder consisting of a pigment, an olefin polymer or copolymer and up to 10% of a silica flow additive in a predetermined pattern on the surface of said polyolefin substrate, fusing the powder particles to each other and to the substrate surface by maintaining the substrate at a temperature of about 115° to 140° C., and adherently bonding the pigmented powder to the substrate by cooling the pattern bearing substrate to effect solidification of the powder.

2. A method of adherently bonding an image on an untreated polyolefin substrate which comprises applying a dry fusible powder consisting of a pigment, an olefin polymer or copolymer and up to 10% of a silica flow additive in a selected pattern to the surface of said untreated polyolefin substrate, fusing the particles of the powder to each other and to the substrate surface to form an adherent layer thereon in accordance with said pattern by maintaining the substrate at a temperature of about 115° to 140° C., and effecting solidification of the fused powder by cooling the pattern-bearing substrate.

3. The method of claim 2 wherein said powder contains about 0.001–1 part by weight of said pigment per part of olefin polymer or copolymer.

4. The method of claim 3 wherein the pigment concentration is from 0.005–0.2 part.

5. The method of claim 4 wherein the pigment concentration is from about 0.02–0.15 part.

6. The method of claim 2 wherein said powder contains about 0.01–10% of said flow additive.

7. The method of claim 2 wherein the particles of the powder have an average particle size from about 1–200 microns.

8. The method of claim 2 wherein the polyolefin substrate is polyethylene and wherein the olefin polymer or copolymer in said powder is polyethylene.

9. An article having an image thereon comprising a non-pretreated polyolefin substrate and adherently bonded thereto in a predetermined pattern, a pigmented, fused powder consisting of a pigment, an olefin polymer or copolymer and up to 10% of a silica flow additive.

10. The article of claim 19 wherein said substrate is polyethylene and wherein said olefin polymer or copolymer in said fused powder is polyethylene.

* * * * *